US008522482B2

(12) United States Patent
Buck

(10) Patent No.: US 8,522,482 B2
(45) Date of Patent: Sep. 3, 2013

(54) DOOR OPENER ASSEMBLY CAPABLE OF HANDS-FREE OPERATION

(76) Inventor: John S. Buck, Camarillo, CA (US)

( * ) Notice: Subject to any disclaimer, the term of this patent is extended or adjusted under 35 U.S.C. 154(b) by 0 days.

(21) Appl. No.: 13/354,795

(22) Filed: Jan. 20, 2012

(65) Prior Publication Data

US 2012/0198774 A1 Aug. 9, 2012

Related U.S. Application Data

(60) Provisional application No. 61/439,526, filed on Feb. 4, 2011.

(51) Int. Cl.
*E05B 1/00* (2006.01)

(52) U.S. Cl.
USPC ..... 49/460; 49/461; 49/386; 16/412; 16/320

(58) Field of Classification Search
USPC ..... 49/460, 461, 381, 386, 400, 401, 49/402; 16/DIG. 14, 320, 412, 422; 292/218
See application file for complete search history.

(56) References Cited

U.S. PATENT DOCUMENTS

| | | | | |
|---|---|---|---|---|
| 2,238,513 | A | 4/1941 | Ward | |
| D165,976 | S | 2/1952 | Goserud | |
| D179,417 | S | 12/1956 | Greenwood | |
| D180,515 | S | 6/1957 | Graves et al. | |
| 2,835,524 | A * | 5/1958 | Russell | 292/128 |
| 3,121,907 | A * | 2/1964 | Stebbins | 16/412 |
| 3,144,268 | A | 8/1964 | Rowe | |
| 3,188,128 | A * | 6/1965 | Olander | 292/240 |
| D203,868 | S | 2/1966 | Bourgeois | |
| D204,235 | S | 4/1966 | Elder | |
| 3,281,177 | A * | 10/1966 | Tenenbaum | 292/241 |
| 3,806,179 | A * | 4/1974 | Roessle | 292/259 R |
| 3,965,528 | A * | 6/1976 | Kissler | 16/110.1 |
| 4,644,689 | A | 2/1987 | Arians | |
| 4,841,754 | A * | 6/1989 | Jones | 70/207 |
| 5,046,770 | A * | 9/1991 | Hansen | 292/218 |
| D343,541 | S | 1/1994 | Kassraie | |
| 5,443,570 | A * | 8/1995 | Hirano | 242/284 |
| 5,983,454 | A | 11/1999 | Hartselle, III | |
| 6,189,183 | B1 | 2/2001 | Hartselle, III | |
| D439,292 | S | 3/2001 | Webber et al. | |
| 6,289,557 | B1 * | 9/2001 | Manson et al. | 16/412 |
| D465,719 | S | 11/2002 | Ditzig et al. | |
| 7,716,789 | B1 * | 5/2010 | Zevallos | 16/412 |
| 7,810,215 | B2 * | 10/2010 | Houis | 16/412 |
| 2006/0200996 | A1 * | 9/2006 | Pearman | 30/158 |
| 2007/0192995 | A1 * | 8/2007 | Houis | 16/412 |
| 2008/0066481 | A1 * | 3/2008 | An et al. | 62/265 |

* cited by examiner

FOREIGN PATENT DOCUMENTS

JP 2003-148005 5/2003

OTHER PUBLICATIONS

Webpage from www.handsfreeconcepts.com dated Nov. 8, 2009 depicting SANI-HANDLE product.

*Primary Examiner* — Katherine Mitchell
*Assistant Examiner* — Marcus Menezes
(74) *Attorney, Agent, or Firm* — Ralph D. Chabot

(57) ABSTRACT

A door opener assembly having a rotatable arm-bar for hands-free use by individuals in high-traffic pedestrian conditions. The rotatable arm-bar has a distal knobbed end and allows users to easily position a wrist or forearm within the hook and to move laterally, as the person moves, as the door is opened and thereafter provides a slide-release of the forearm or wrist. The smooth surface and design of the arm-bar allows users to disengage from contact without risk of injury occurring such as from the unexpected opening of the door from the opposite direction.

12 Claims, 5 Drawing Sheets

FIG. 1
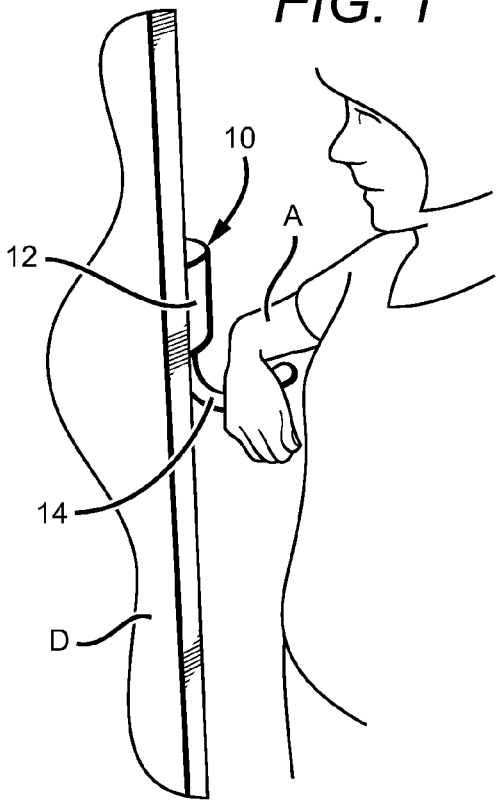
FIG. 2
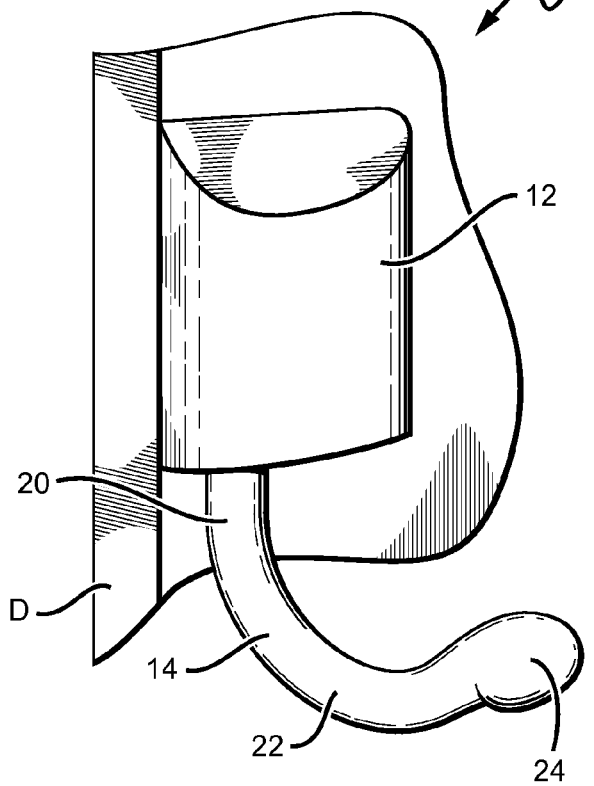
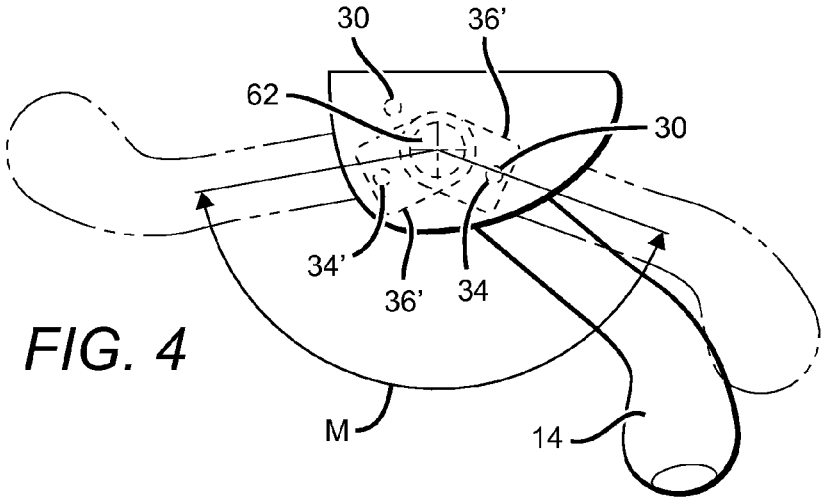
FIG. 4

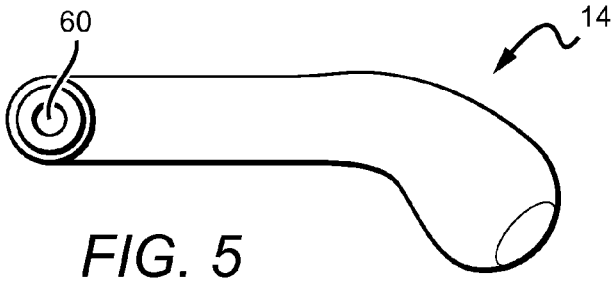
FIG. 5
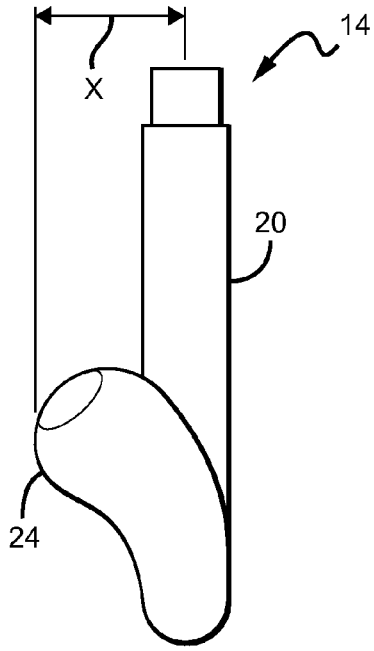
FIG. 7
FIG. 6
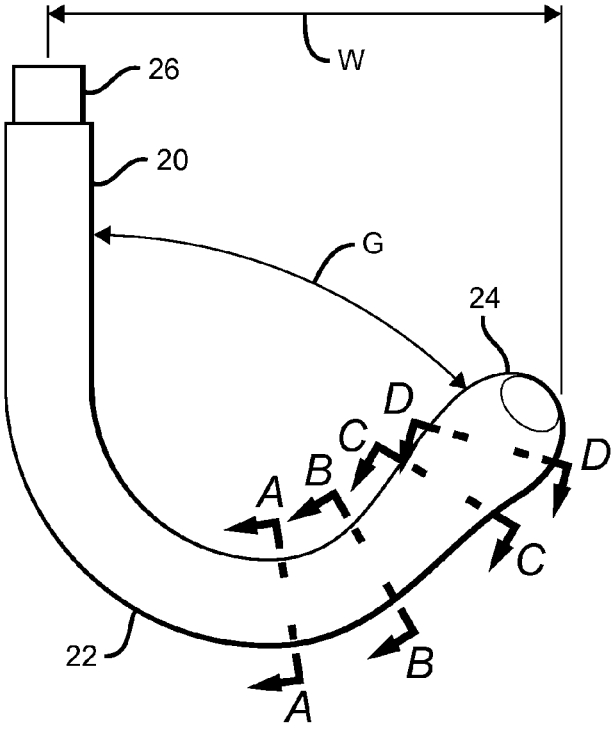

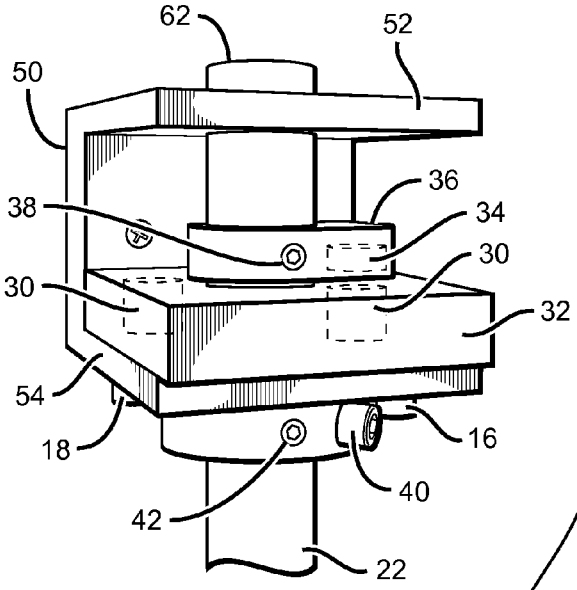
FIG. 8
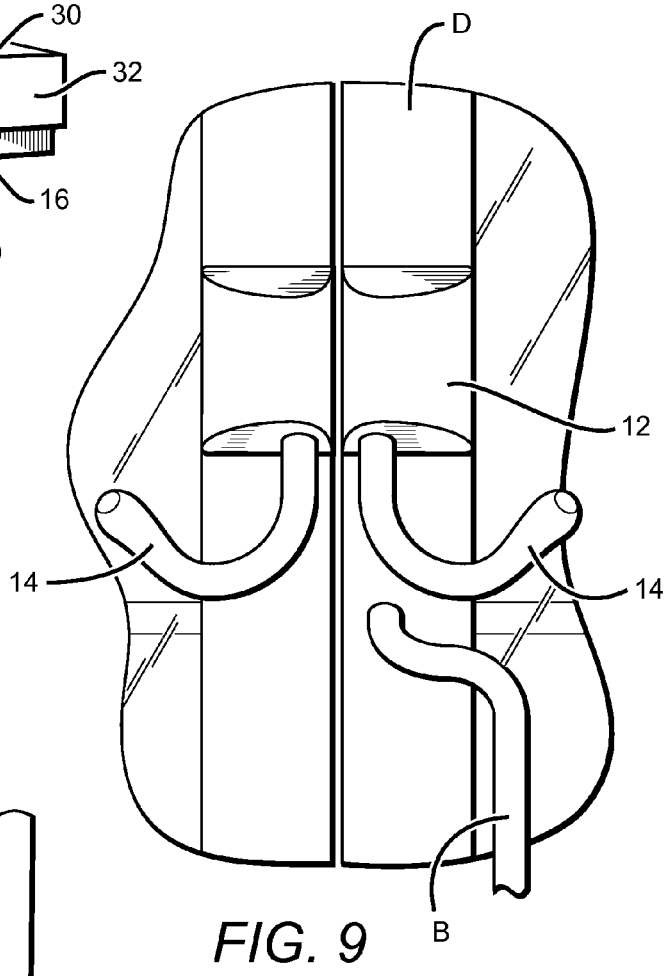
FIG. 9
FIG. 10
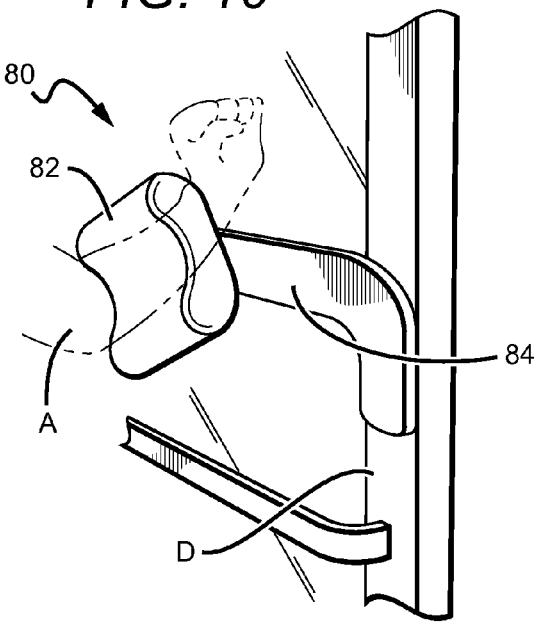

FIG. 11
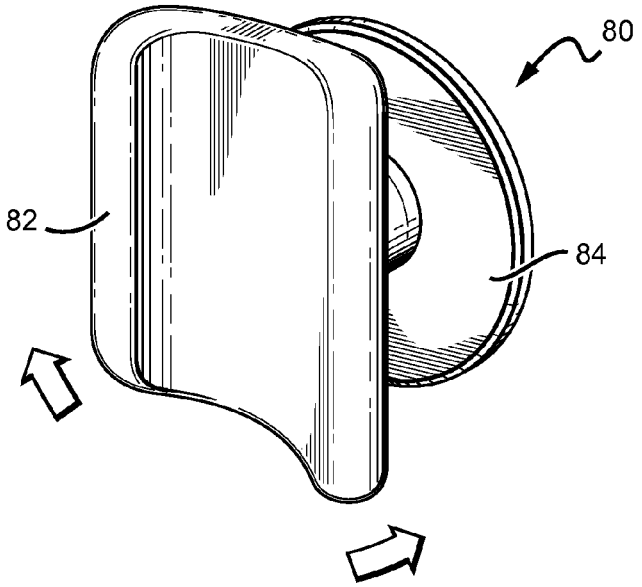
FIG. 12
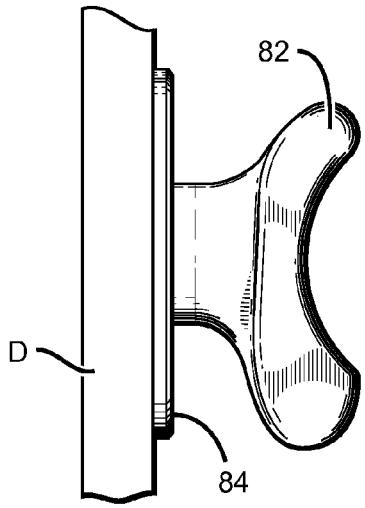
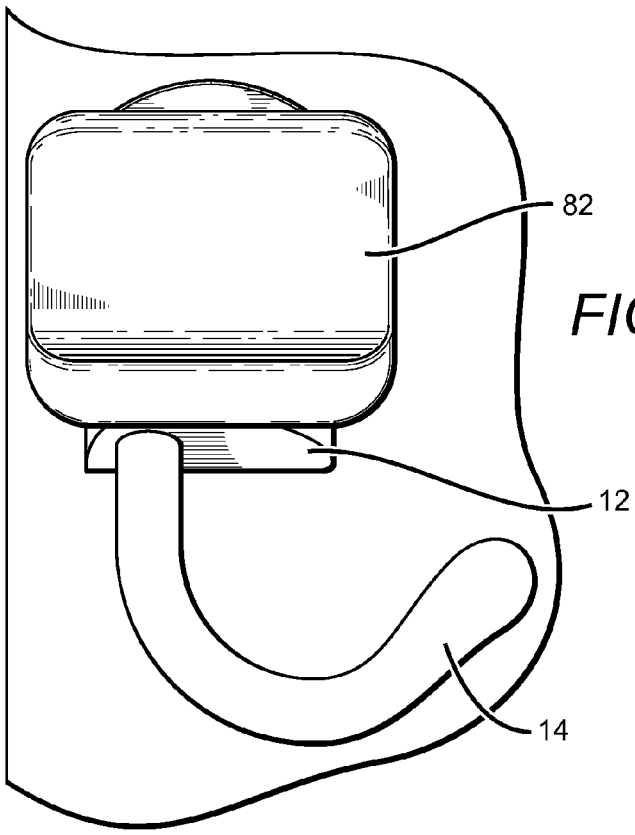
FIG. 13

DOOR OPENER ASSEMBLY CAPABLE OF HANDS-FREE OPERATION

BACKGROUND OF THE INVENTION

This invention relates to handles for doors and, in particular, to a method and apparatus for opening doors without using hands.

DESCRIPTION OF THE PRIOR ART

Grab-bar handles, as they are termed by the trade, are used on most high-traffic manual door entries. Often a vertical bar is used on the entry pull-side of the door, with a horizontal bar on the exit push-side, but other combinations are also used. These vertical bars are typically 10-12 inches high, while the horizontal bars are usually about the width of the door. Some bars are rectangular, some are round, and some are custom shaped; yet all have the characteristic that they are easy to see peripherally as the user approaches the door, and they are all easy to grab and use with little chance for sustaining an injury. Although grab-bars and doorknobs both present minimal risk of physical injury, doorknobs present a smaller profile which is often times more difficult for a user to quickly see and grab in fast paced high-traffic situations; thus doorknob profiles, because of their small shape, are seldom, if ever used for this type of application.

Opening doors using a hands-free technique is well known in the prior art. One reference which illustrates a hands-free door handle is U.S. Pat. No. 2,238,513 issued to Ward and discloses a door handle for hands-free opening of a door latch. The handle comprises a proximal end connected to the door, an elongated rod portion extending parallel to the door and in a direction away from the latch, a hook portion and a distal end orientated to be facing downward. The handle can be displaced along an arc parallel to the door, either upward or downward to release the latch. Ward does not pertain to high-traffic uses since a latch mechanism is operated by the movement of the handle.

An issue with the use of grab-bar handles is that they can transmit germs left by a previous user to a subsequent user. Grabbing a door handle by a hand can contact the contagion left by previous users. This contact could lead to respiratory infection should the individual subsequently place his hand in close proximity to the nose or mouth before washing his hands or application of a hand sanitizer.

It is well known that hand washing is the most recommended way of preventing contact of unclean fingers with the eyes, nose and mouth. However, in public situations, it is not possible to promptly wash hands. The U.S Center for Disease Control and Prevention (CDC) reports that up to 80% of germs are transmitted by the hands, and that doorknobs and grab-bars are one of the worst contributors to this problem.

A prior art example of a hands-free door application taking into consideration the need for sanitary usage is U.S. Pat. No. 6,289,557 issued to Manson et al. which discloses a sanitary door handle assembly for opening a door. The handle portion is arcuate and having the dished side of the handle generally facing one side of a door. While Mansen et al. discloses a hands-free door handle, and one of the disclosed embodiments further describes a resilient handle to displace and free an engaged wrist or forearm if the door is unexpectedly opened feature, this resiliency feature is limited to the mechanism utilized and the overall design of the door handle remains inherently prone to cause injury if a door is unexpectedly opened from the opposite direction.

Other devices for manual hands-free opening of a door include a product marketed under the trademark SANI-HANDLE. This device comprises a rigid wing extending at an upward angle away from the door. Because of its stationary design, a user slips his forearm into the wing so that the forearm is essentially parallel with the door face. This design requires the user's elbow to be close to the door and thus the user is close as well. This proximity to the door can make a user susceptible to injury particularly if the door is swung open from the opposite side while the user is engaging the device.

SUMMARY OF THE INVENTION

The purpose of my invention is to provide a door opening mechanism which is simple to use, allows a user to avoid grabbing a handle by the hand to open a door in which the handle may be contaminated with germs and provides reliable and injury-free operation.

My invention is a door opening device which incorporates an arm-bar that can rotate from an initial position in front of a hinged door required to be pulled open to a position where the distal end of the arm can extend beyond the swinging edge of the door.

My invention is suitable for opening doors used in high-traffic situations without having to place a hand on a handle and risk contracting germs or other infectious organisms which may be present. High-traffic situations are those where the doors will be opened and closed on a frequent basis. Some examples include doors to office buildings, hotels, department stores, medical buildings, public restrooms, etc. My invention can also be used in low-traffic conditions.

My invention is designed for a user to be able to peripherally recognize and easily engage the arm-bar without having to concentrate and thereafter be able to disengage from contact quickly and easily.

My door opener assembly is operatively attached to the face of a hinged door where a pulling force is required to swing the door open. Operative attachment means that the location of attachment to the door is suitable for a human to engage the arm-bar while standing and that the location is close to or at the swinging edge of the door to maximize leverage and thus require only a minimal opening force to pull the door open. Doors typically used in high-traffic situations are well balanced and minimal pulling force is required to open even though the doors are usually constructed of heavy material. These doors typically incorporate the use of horizontal and/or vertical grab bars. Preferably, the door opener assembly will be located at or near the swinging edge of the door and directly located above a vertical grab bar or handle. Attachment of my door opener to the door can be by any means well known in the art. Some examples of acceptable means for attachment include, but are not limited to threadable engagement, use of an adhesive, or use of suction cups.

The door assembly comprises an arm-bar having a configuration which can be described as having a general hook looking shape that is rotatably mounted to a support location which is operatively attached to the door. The arm-bar can be constructed of any material that is traditionally suited for handle applications. Preferably, the arm-bar is an integral component made of a rigid plastic or metal such as aluminum, brass or stainless steel and having a polished surface so a user's wrist/forearm can slide off the arm-bar as will be discussed later.

The arm-bar has a bend portion, a distal end and a proximal portion operatively connected to the support location. The arm-bar is biased into an initial or first position as will be discussed later.

It is to be understood the rotational aspect of my door assembly is in a plane that can be described as once my assembly is properly attached to the side of a door, the arc of rotation is in a substantially perpendicular plane.

My invention can utilize an arm-bar configuration where either a user's wrist/forearm is raised into contact with the bend portion from below (designated the 'n' configuration) or, more preferably, where the user's wrist/forearm is lowered into contact and positioned upon the bend portion (designated the 'u' configuration).

Other configurations for my arm-bar could be utilized so long as they are rotatable about the support location in a substantially horizontal plane and provide a hands-free application for opening a door.

Preferably, the arm-bar further comprises a proximal shank portion which is rotatably mounted to the support location. The shank portion extends from the support location generally parallel to the hinged door. Rotation of the distal end of the arm-bar occurs substantially along the horizontal plane and most preferably, along the horizontal plane.

In the more preferred 'u' configuration, the bend portion has a top surface which has an appropriate surface area that is comfortable for a human to rest his forearm or wrist upon and to thereafter exert upon a small opening force as will be discussed later. If the top surface area of the bend portion were too small, the force applied by the user would be focused on a limited area of the forearm/wrist which could result in discomfort at the site of engagement.

An important feature of my invention is the ability of the arm-bar to rotate from an initial position, where the distal end is located in front of the door face between the door face and the user as illustrated in FIG. 1, to a releasing position where the distal end is located beyond the vertical swinging edge of the door as the user's wrist disengages contact with the arm-bar. It should be noted the user can disengage at any point before the releasing position is reached; the releasing position merely refers to the maximum rotation limit of the arm-bar in the clockwise direction. With respect to the maximum clockwise rotation limit, the term beyond the swinging edge refers to the distal end being located further in a horizontal direction than the vertical swinging edge.

The support location for the arm-bar is preferably a housing which is operatively attached to the door. In emergency situations where a temporary use is needed, another embodiment is a housing incorporating one or more suction cups that can be temporarily affixed to the door.

The distal end preferably is of a general knob configuration having an orientation toward the swinging edge of the door as shown in FIG. 3. This preferred knob configuration allows a human's wrist or forearm to easily slide off the arm-bar without risk of injury or article of clothing being caught by the device.

In my preferred 'u' configuration, when my door opening assembly is operatively attached to a door, the distal end is facing in a general upward direction. Stated another way, the arm-bar has a general hook-shape configuration, except that the bend portion is bent outward as viewed in FIG. 6.

In an alternative 'n' configuration, the distal end is facing in a general downward direction, preferably 30-60 degrees from horizontal which permits a user to engage the lower surface of the bend portion by raising his forearm/wrist to contact, and then disengaging at any time by lowering his forearm or, if the arm-bar has rotated clockwise to its maximum extent as the user is walking through the door opening, the user's wrist/forearm will disengage as it slides away from contact off the distal end.

An anticipated use of my invention is on commercial doors which will repetitively open and close in high-traffic pedestrian applications. In a typical commercial setting, individuals will be behind the user and others may be on the opposite side of the door desiring to travel in the opposite direction. To prevent injuries, it is necessary that the user be able to immediately remove his wrist or forearm from contact with the arm-bar without any chance that the wrist or forearm could catch in the device which could cause an arm, shoulder or other injury. By example, for my preferred 'u' embodiment, the user can release contact with my arm-bar configured for use by a right hand on a right side door by lifting in the +y direction, sliding over the distal end in a −x direction, sliding across the bend portion in the +z direction or any combination of the above.

The ability to easily disengage from the arm-bar in various directions as a result of the arm-bar geometry and orientation are safety features of this invention.

Thus, the design of my arm-bar is sized to permit a user's forearm/wrist to be quickly positioned into contact with the bend portion and after a subsequent opening force is applied, to thereafter quickly and easily disengage contact; i.e. the forearm/wrist displaced from the space formed between the distal end, the bend portion and the shank portion of the arm-bar.

My invention is usable in both high and low traffic door applications. It provides the user with an option. Although the arm-bar can be grabbed by the hand and used to open a door, my invention is directed toward the user positioning the forearm/wrist across the bend portion. For the 'u' configuration, the user's wrist/forearm is placed upon the bend portion and gravity along with a slight pulling force is used to swing a door open and avoid hand contact with the arm-bar which may have germs deposited by previous users. For the 'n' configuration, the user's wrist/forearm is moved upward into contact with the bend portion and a pulling force is used to swing the door open.

For the 'u' configuration, my arm-bar assembly is positioned at an appropriate height on the door so persons approaching the door assembly can easily lay their wrist or forearm upon the bend portion. In a typical installation, my arm-bar assembly would be positioned upon the door slightly above a vertical grab bar as illustrated in FIG. 9. Operative attachment of the housing proximate to the vertical swinging edge of the door permits the arm-bar to be rotated into a position where the distal end is beyond the outer swinging edge of the door.

The engagement zone, meaning the distal end and bend portion of the arm-bar, is appropriately sized for a user's forearm/wrist to contact. In a preferred embodiment, the arm-bar, from its initial position, can easily rotate in either direction to accommodate the user's wrist/forearm as it is placed upon the bend portion. With gravity resting the user's forearm upon the arm-bar with the wrist cradled over the bend portion, the user applies a pulling force upon the arm-bar to swing open the door.

It is to be understood that the pulling force to open the door is applied by the user's wrist and/or forearm. This pulling force is applied generally to the bend section. As the door swings open, the arm-bar rotates in response to the continued contact of the user with the arm-bar. As this rotational movement occurs and the user continues to walk through the door opening, the wrist/forearm position of the user slidably displaces in a direction toward the user's body and eventually disengaging contact with the arm-bar. Due to the smoothness and design of the arm-bar, there is nothing upon which the user or the user's clothing can catch.

Since most commercial doors are well-balanced with existing door-closing devices, the weight of the persons arm alone provides much of the force required to open the door. With the weight of the user's arm resting upon the bend portion, for example, ten pounds force downward due to gravity, any pulling force the user exerts toward himself to open the door will be applied to overcome the pull resistance of the door, which in commercial application is typically between 1-7 lbs-force. Thus, the user's arm weight is used as part of the pulling force for the 'u' configuration.

In the preferred arm-bar design, the arm-bar is cylindrical as it extends downward from the support location to about the low point of the bend portion. Extending past this point to the distal end, the bend portion gradually becomes more oblong and larger in shape and, bends towards the swinging edge side of the door.

The preferred knob located generally at the distal end helps to further spread the weight of the user's wrist and forearm over a larger area.

The bend in the arm-bar seen in FIG. 7 towards the swinging edge of the door aids the user's forearm and wrist to slide easily and smoothly while still providing a level of gripping force to control the door.

Preferably, overall rotational movement of the arm-bar is limited to about 160 degrees. Part of this degree of rotation permits a user to pull the door open and begin to walk through the door opening while still in contact with the arm-bar since the arm-bar is rotating clockwise. A smaller part of the degree of rotation is provided in case, for example, a child's head were to accidentally bump the distal end. For these situations, the arm-bar can rotate up to about 20 degrees from the door face in a counterclockwise direction from the initial position. This rotation ability acts much like a shock absorber to dissipate an impact force.

After the user releases contact to the arm-bar, it is biased to automatically return to the initial position ready for the next user; typically in less than three seconds. This means for biasing to the initial position can include the use of stretchable material such as natural rubber, synthetic rubber, or the use of coils, springs, leafs, or mechanical, hydraulic or pneumatic devices.

However, the means for biasing to the initial position can also be the use of a plurality of magnets to bias or urge a rotating component to one position. Using magnets as part of my door opener assembly, at least two magnets are positioned within the housing to bias the arm-bar to the initial position; one magnet rotating with the arm-bar and the other stationary with the housing. Small magnets simulate push forces, pull forces and forces to maintain the initial position. In a preferred embodiment, one set of magnet(s) are located in the housing to rotate with the shank portion and at least two sets of magnets are located in the housing which remain stationary. Another embodiment can have two sets of magnets rotating and one set stationary. The dynamics of utilizing magnets can be easily modified and fine-tuned and even drastically changed by varying the number of magnets stacked at each position, slightly changing their relative location(s) or even adding additional magnet positions. In one embodiment, one of the members used for position of the magnets can be adapted with a single arced aperture having a plurality of notches whereby the magnet locations can be easily changed to a different position along the arc.

Use of magnets has benefits of increased reliability, durability and operational flexibility in accordance with the dynamics of the invention. Since the dynamics enhance the comfort, safety and reliability of use, magnets provide an enormous advantage over extension, compression, torsion or other types of springs which are more prone to premature failure relative to magnet usage.

The use of the magnets will allow easy compensating adjustments which may be required for different arm weights and material changes, such as for example, use of arm-bars constructed from brass rather than from a lighter thermal-plastic material. This consideration would also apply for versions of my invention for down-sizing the size of the arm-bar and support housing for use in more child friendly applications such as elementary schools.

A further alternative embodiment would have the arm-bar constructed as a composite with the distal end and a segment of the bend portion constructed of a resilient material such as solid rubber or a polymeric material.

The aforementioned door opener assembly uses a pulling force to swing a door open. Located on the opposite face of a door to which my door opener assembly is operatively attached can be installed a push door opener assembly the type of which is illustrated in FIGS. 10-12. The push door opener assembly comprises a housing attached to the door and a shaft extending away upon which a contoured pad is rotatably mounted. The push door opener assembly can be mounted upon the opposite door face and a preferred embodiment permits the contoured pad to be rotated about the attachment axis. Magnets are used for returning the contoured pad to its initial position in a similar way as described for the arm-bar.

In another application, it may be useful to combine the push and the pull feature on a single door face as illustrated in FIG. 13. In still another application, the pull assembly could also be used for opening refrigerator doors, including commercial refrigerator doors.

DESCRIPTION OF THE DRAWINGS

FIG. 1 illustrates a user's initial forearm and wrist placement upon the arm-bar of the door opener assembly.

FIG. 2 is a perspective view of one embodiment of the door opener assembly.

FIG. 4 is a top view of one embodiment of my handle assembly.

FIG. 5 is a top view of the arm-bar.

FIG. 6 is a side view of the arm-bar.

FIG. 7 is a front view of the arm-bar.

FIG. 8 is a cut-away view of the housing and attachment of the arm-bar in the initial position.

FIG. 9 illustrates a use for my invention in a commercial double-door application.

FIG. 10 illustrated a contoured push plate located on the door face opposite the arm-bar.

FIG. 11 is a perspective view of the contoured push plate.

FIG. 12 is a side view of the push plate.

FIG. 13 is an embodiment incorporating both the arm-bar and push plate.

DETAILED DESCRIPTION OF THE PREFERRED EMBODIMENT

Figure 3:
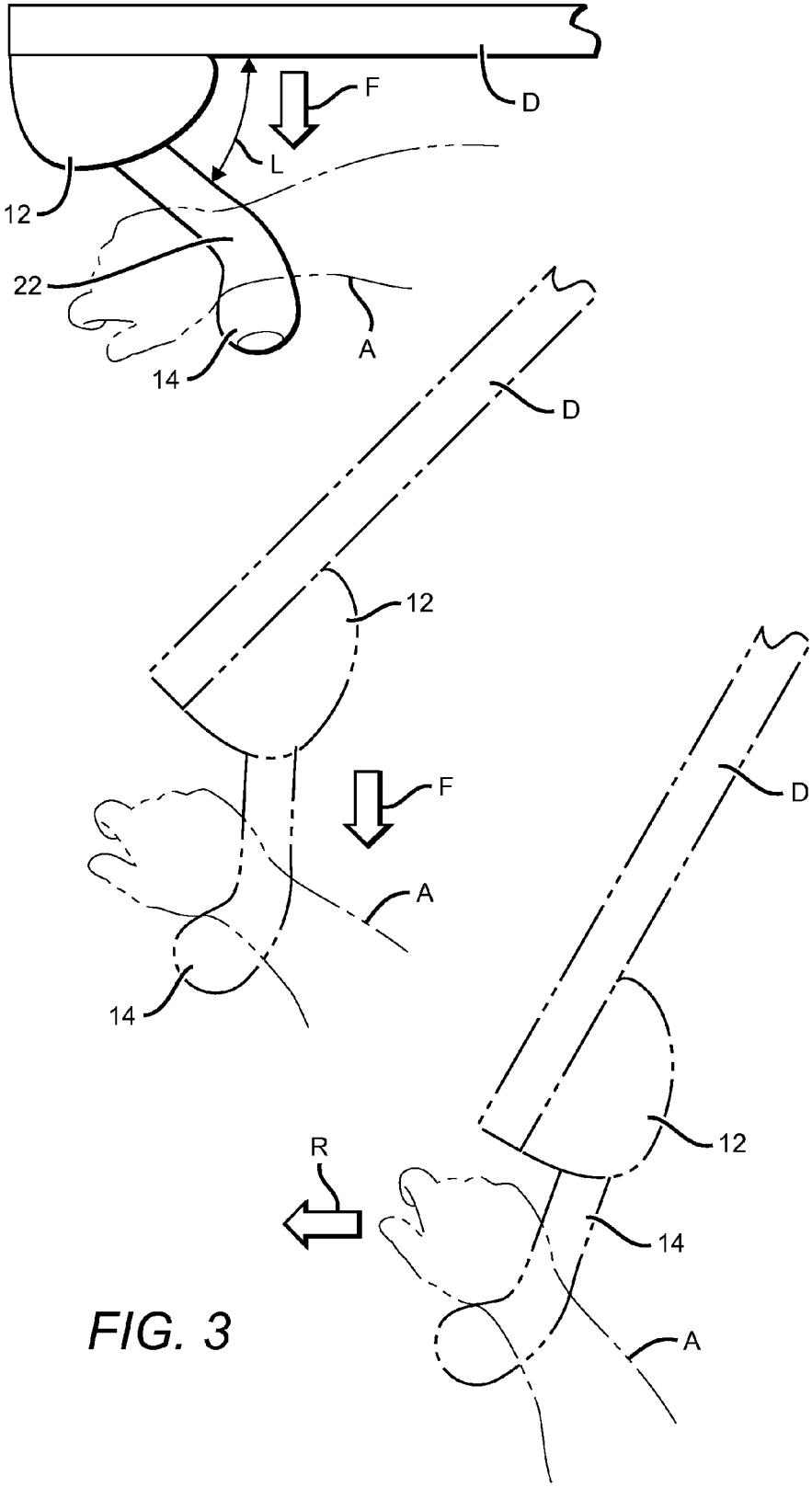
FIG. 3 is a top view showing the relation of the door opener assembly to the door and the rotational movement of the arm-bar.

The illustrations provided are not necessarily to scale but are for general informational purposes. FIG. 1 generally illustrates the position of a user's forearm/wrist A in relation to my door opener assembly 10 which is operatively attached to a door D and with arm-bar 14 in the u-configuration.

Since most high-traffic doors utilize a metal frame and glass, door opener assembly 10 is threadably secured to the door's metal frame in a position above any existing vertical grab bar. It should be noted however, a version of door opener assembly 10 could include suction cups for attachment to a door where the surface of attachment may or may not be a portion of the door's metal frame.

The movement shown in FIGS. 3 and 4 refer to the movement of an arm-bar attached to a right-side hinged door. The positioning and movement for an arm-bar attached to a left-side hinged door would be the mirror image.

Referring to FIG. 2, the door opener assembly 10 is comprised of two subassemblies, the housing 12 and the arm-bar 14. Arm-bar 14 comprises a shank portion 20, a bend portion 22, and a distal end 24. The distance between the shank portion 20 and distal end 24 generally defining a gap G as illustrated in FIG. 6.

Arm-bar 14 is rotatably attached to housing 12 with the rotational movement illustrated in FIG. 3. The closed position of hinged door D, housing 12, and the initial position of arm-bar 14 appear in solid line when forearm/wrist A is initially placed upon bend portion 22. The initial position of arm-bar 14 relative to door D is represented by angle L which is about 40 degrees or about 140 degrees from the swinging edge of the door. In this initial position represented by the solid line in FIG. 4, arm-bar 14 is rotatable in either clockwise or counter-clockwise direction. Overall, the rotational movement of arm-bar 14 is represented by angle M and is about 160 degrees. Referring to FIG. 3, the dashed lines represent positions of hinged door D, housing 12 and arm-bar 14 after opening force F has been applied. As the user begins to walk to and through the door opening, the position of arm-bar 14 rotates toward the swinging edge of door D.

The counter-clockwise position of arm-bar 14 in dashed line in FIG. 4 represents a possible position if hinged door D is inadvertently bumped by an object such as a child's head. This rotational movement would lessen the force of impact and minimize any injury. Also, this movement is limited to prevent distal end 24 from impacting the door surface if it is accidently displaced counter-clockwise.

Located within housing 12 is are magnet sets 30 and 34 located within housing 12 which provide a relatively small biasing force is used to urge arm-bar 14 into the initial position. If the correct magnet strength is used, arm-bar 14 will responsively rotate upon application of force F to swing open door D.

As a consequence, even an impact such as a child's head accidentally bumping arm-bar 14 will not suffer an injury. Also, the enlarged dimensions of distal end 24 serve to prevent injury which may otherwise occur if the end had sharp edges. During the installation process of door opener assembly 10 to door D, maintenance personnel will check to ensure the correct magnet strength is used for the particular type of door. Magnets can be changed by removing the cover to housing 12 and inserting the magnets into appropriately sized apertures (not shown) for receiving the magnets into rotatable block 36 and stationary block 32. FIG. 8 illustrates the relative position of magnets 30 and 34. It is to be understood that blocks 32 and 36 are constructed of a non-magnetic material.

In normal operation, as soon as forearm/wrist A is placed upon bend portion 22, it exerts a force upon arm-bar 14 caused by its weight. The user thereafter can exert an additional, minimal pulling force F in the direction shown in FIG. 3 to begin swinging open hinged door D. As door D is swung open, the user moves and begins to walk through the door opening. Relative to the user's movement and continued engagement to arm-bar 14, arm-bar 14 rotates in a clockwise direction up to its maximum rotational extent at which continued user movement through the door opening causes forearm/wrist A to slide in direction R until forearm/wrist A completely disengages from contact with arm-bar 14.

Mirror-image designs as illustrated in FIG. 9 are used for adjacent doors (double doors) which are normally used to handle high-traffic situations. It is possible for two persons to simultaneously pull open both doors, although they would have to pay attention not to bump each other. For the situation where a person is exiting via one door and another person is entering thru the other door, there is still adequate room to maneuver.

My door opener assembly can also be used on a typical aluminum-glass 'storefront' door D positioned near or adjacent to the swinging edge. Housing 12 is attached above a vertical grab bar B similar to that illustrated in FIG. 9 which is commonly used currently, so that the person entering the door has the choice of using grab bar B or arm-bar 14.

The limits of travel of arm-bar 14 in each direction are limited by stops 16 and 18 within housing 12 as shown in FIG. 8. Within housing 12 is a U channel 50 having a top section 52 and a bottom section 54 each having a hole having a common axis of symmetry with the other. A shoulder bolt 62 is accepted through the holes in top section 52 and bottom section 54 and threadably secured to threaded hole 60 located at the top of shank portion 20. The head of shoulder bolt 62 rests upon a thrust bearing (not shown) partially positioned in the annular region of top section 52 to secure arm-bar 14 to housing 12. A washer bearing (not shown) is positioned in the annular region of bottom section 54 for centering the base of shoulder bolt 62. As illustrated in FIG. 8, a rotor assembly is provided in housing 12 which include stationary magnets 30 disposed in respective recesses in block 32 and traveling magnet 34 disposed in a recess in rotatable block 36 which is secured to the proximal end of shank portion 20 by screw 38. A stop pin 40 is also secured to the proximal end 26 of shank portion 20 by screw 42 located on the rotating part of the mechanism makes contact with stops 16 and 18 to define the extent of rotation M of arm-bar 14. FIG. 4 also shows the extent of travel of rotatable block 36 and traveling magnet 34 in the clockwise direction as 36' and 34' respectively.

It should be noted that a small space exists between the adjacent faces of block 32 and rotatable block 36 so that rotatable block 36 does not frictionally engage.

The use of magnets 30 and 34 in housing 12 bias arm-bar 14 into the initial position and provides a smooth continuous rotational movement once the user has placed forearm/wrist A upon arm-bar 14 and begins to exert a pulling force F.

The exact sequence for rotation of arm-bar 14 and opening of door D depends on the position of the user, their change of position and the movement of their forearm/wrist A.

If, for example, a person were to stand directly in front of housing 12, rest forearm/wrist A upon bend portion 22 and exert a pulling force F without moving his feet, arm-bar 14 would first move from its initial position and point at the person, being then approximately perpendicular to the adjacent face of door D. If the user were to take a step directly backward, which would further cause forearm/wrist A to pull on door D, the door would open further and the angle would decrease some and the arm bar would actually rotate toward and then past the swinging edge of the door, as seen by a person standing behind the user. The user could then step to the left to begin their entry thru the door. At this point, if the door opening was sufficiently wide, wrist/forearm A would naturally slide off the smooth arm-bar 14 in direction R as illustrated in FIG. 3 as the user moves further through the door opening.

The user's engagement of forearm/wrist A to arm-bar 14 can be as short as the time it takes to complete application of opening force F or, the engagement time can be delayed considerably and the person can in essence 'walk the bar' i.e. continue engagement to arm-bar 14 until the user is moving through the door opening.

Another method for opening swinging door D is by a user giving arm-bar 14 a hard yank, causing door D to swing open without moving from their initial position. As the door opens rapidly, the arm-bar 14 will quickly rotate and will again allow the slide release of the user's arm.

After a person has used the invention a couple of times, the operation becomes smooth, where the user's position and the pull angle are changing continually. Thus, the users arm typically enters and rests in the arm bar as shown in FIG. 1, and is released typically by the slide action as shown in FIG. 3.

In a most preferred embodiment of my invention, the arm-bar has a configuration as shown in FIG. 6 in accordance with the dimensions listed in the following table:

TABLE 1

Circumference of Arm-Bar and degrees from Vertical

| Section | Circumference (in) | degrees from vertical |
|---|---|---|
| A-A | 2.945 | 0-90 |
| B-B | 3.14 | 90-120 |
| C-C | 4.28 | 120-150 |
| D-D | 5.12 | 150-165 |

FIGS. 6 and 7 also present additional dimensions W and X where W is about 5.9 inches and X is about 1.8 inches.

FIGS. 10-13 illustrate embodiments which utilize a push door opener assembly 80 which comprises contoured pad 82 rotatably mounted to mount 84 which is attached to door D. The push door opener assembly 82 can be constructed of any durable material but is preferably constructed of hard plastic, or a metal such as aluminum, brass or stainless steel. Assembly 80 can be mounted upon the door face opposite door opener assembly 10 either directly to the door face or to mounting bar 84 as shown in FIG. 10 or it can be configured to part of the door opener assembly as illustrated in FIG. 13. It should be noted that contoured pad 82 is weighted so that gravity will assist in returning to its initial position. Also, magnets are also used to assist in biasing in the initial position. Contoured pad 82 can be rotated 360 degrees. Rotation of contoured pad permits a more comfortable engagement since the user, once having their forearm cradled in contoured pad 82, can rotate to any desired position as illustrated in FIG. 10.

I claim:

1. A door opener assembly for attachment to a side of a hinged door to which a hands-free pulling force can be applied to swing open said hinged door said door opener assembly comprising:

a support for attachment to the side of the hinged door requiring a pulling force to swing the hinged door open;

an arm-bar comprising a proximal shank portion rotatable about its longitudinal axis and connected to said support, a bend portion having a distal end extending from said shank portion, said distal end displaceable along an arc of about 160 degrees;

at least one magnet operatively mounted to said arm-bar and at least one magnet stationarily mounted to said support, said magnets positioned to bias said arm-bar to an initial position along said arc of about 160 degrees; and, when said support is attached to the side of the hinged door, said shank portion extends downward and parallel to the side of the hinged door and said distal end travels in a substantially perpendicular plane relative to the side of the hinged door when a pulling force is applied to said arm-bar and returns said arm-bar to said initial position when the pulling force is released.

2. The door opener assembly of claim 1 where once said support is operatively attached to the side of the hinged door, said arm-bar is of sufficient length to be rotated from said initial position to a position where said distal end extends past the distal edge of the hinged door.

3. The door opener assembly of claim 1 where said distal end has a knob configuration.

4. The door opener assembly of claim 1 where said proximal portion has a longitudinal axis where said at least one magnet operatively mounted is rotatably mounted about the longitudinal axis of said proximal portion.

5. The door opener assembly of claim 1 where said arm-bar is an integral component selected from the group consisting of: rigid plastic, aluminum, brass and stainless steel.

6. A door and door opener assembly comprising:

a door having an inner hinged edge and a laterally spaced outer swinging edge, and generally parallel faces extending between said edges; said door having a first parallel face to which a pulling force is applied to swing open said door; and a second parallel face to which a pushing force is applied to swing open said door;

a support housing operatively attached to said door face to which a pulling force is applied to swing said door open;

an arm-bar comprising a shank portion rotatably mounted to said support housing, a bend portion extending from said shank portion, said bend portion having a distal end; said shank portion extending from said support housing and parallel to the parallel faces of the door; and, said shank portion rotatable about its longitudinal axis from a first position where the distal end of said arm-bar is located about 40 degrees from the inner hinged edge of the door to a second position where said arm-bar is located about 180 degrees from the inner hinged edge of the door, and at least one magnet operatively mounted to said arm-bar and at least one magnet stationarily mounted to said support housing, said magnets positioned to bias said arm-bar to an initial position; and, when said support housing is attached to the side of the door, said shank portion extends downward and parallel to the side of the door and said distal end travels in a substantially perpendicular plane relative to the side of the door when a pulling force is applied to said arm-bar and returns said arm-bar to said initial position when the pulling force is released.

7. The door and door opener assembly of claim 6 where at least one magnet is operatively mounted to said arm-bar and at least one magnet is stationarily mounted to said support housing, said magnets positioned to bias said arm-bar to said first position.

8. The door and door opener assembly of claim 6 where said distal end has a knob configuration slightly sloped from the diameter of said bend portion.

9. The door and door opener assembly of claim 6 where said shank portion is further rotatable about its longitudinal axis from said first position about 20 degrees in the direction opposite of said second position.

10. The door and door opener assembly of claim 6 where said bend portion is in a u-configuration.

11. The door and door opener assembly of claim 6 where said bend portion is in an n-configuration.

12. The door and door opener assembly of claim 6 where said arm-bar is an integral component selected from the group consisting of: rigid plastic, aluminum, brass and stainless steel.

* * * * *